United States Patent [19]

Ishida

[11] 4,270,322

[45] Jun. 2, 1981

[54] DOUBLE-GLAZED WINDOW STRUCTURE

[75] Inventor: Kinji Ishida, Toyama, Japan

[73] Assignee: Yoshida Kogyo K.K., Tokyo, Japan

[21] Appl. No.: 25,265

[22] Filed: Mar. 29, 1979

[51] Int. Cl.[3] ..... E04B 3/26

[52] U.S. Cl. ..... 52/98; 52/202

[58] Field of Search ..... 52/202, 203, 98, 100, 52/217, 788; 49/505

[56] References Cited

U.S. PATENT DOCUMENTS

| | | | |
|---|---|---|---|
| 1,636,593 | 7/1927 | Dennis | 52/788 |
| 2,859,493 | 11/1958 | Matschke | 52/202 |
| 2,916,112 | 12/1959 | Kiehl | 52/202 |
| 3,024,503 | 3/1962 | Zoellner | 52/202 |
| 3,436,884 | 4/1969 | Bell | 52/202 |
| 3,971,178 | 7/1976 | Mazzoni | 52/202 |
| 3,984,955 | 10/1976 | Yamamoto | 52/202 |
| 4,098,027 | 7/1978 | Crance | 52/98 |

FOREIGN PATENT DOCUMENTS

| | | | |
|---|---|---|---|
| 1683353 | 10/1969 | Fed. Rep. of Germany | 49/505 |
| 2426718 | 12/1975 | Fed. Rep. of Germany | 49/505 |
| 2610214 | 9/1977 | Fed. Rep. of Germany | 52/202 |
| 2719374 | 11/1978 | Fed. Rep. of Germany | 52/203 |
| 571145 | 12/1975 | Switzerland | 52/217 |

*Primary Examiner*—Price C. Faw, Jr.
*Assistant Examiner*—Henry E. Raduazo
*Attorney, Agent, or Firm*—Hill, Van Santen, Steadman, Chiara & Simpson

[57] ABSTRACT

A structure for constructing a double-glazed window by attaching an add-on outer window frame to the exterior surface of an existing window opening having a ready-built inner window frame is provided, in which an intermediate frame is connected to the inboard periphery of the outer window frame to enter the window opening closely reaching the outboard periphery of the ready-built inner window frame and a gap between the intermediate frame and the ready-built inner window frame is filled by a sealing material to form a joint.

3 Claims, 3 Drawing Figures

DOUBLE-GLAZED WINDOW STRUCTURE

BACKGROUND OF THE INVENTION

The present invention relates to a double-glazed window structure and in particular, to a structure of a double-glazed window which is formed by attaching an add-on outer window frame to a ready-built inner window frame fixed to a window opening of a finished building.

There may often be cases in which remodeling of a ready-built single-glazed window into a double-glazed window is required in order to increase the sound deadening effect or heat insulation of the window to comply with changes in the use of the building concerned or in the environmental conditions. In such cases, it is an economical way that an add-on outer window frame is attached to the outside of the ready-built window frame, instead of remodeling the window in its entirety. A double-glazed window structure for the purpose is known in which several anchorages with screw sockets (nuts) are provided at the exterior surface of the building wall by being embedded through the outer finishing layer in the body of the building around the window opening at suitable distances from each other, the anchorages being utilized for fastening the add-on outer window frame (see, for example, Japanese Utility Model Disclosure No. 51-62233).

In the above-described structure of the prior art double-glazed window, the add-on outer window frame is attached around the window opening by being fastened to bracket members with bolts and supported by the bracket members which in turn are each fastened to each of the anchorages embedded in the body of the building and, at the same time, the intermediate frame provided at the inboard periphery of the outer window frame is connected at the lower cross-member or sill thereof with screws to the outboard periphery of the ready-built inner window frame.

It is usual that the outward stretch of the window opening, i.e. the distance between the outboard periphery of the ready-built inner window frame and the exterior surface of the wall or the edge of the water nosing, if any, differs considerably according to discrepancy between the centerlines of the wall and the window frame. Satisfactory accuracy is not always ensured in the finishing of the exterior surface of the wall to which the bracket members are to be fastened with the anchorages and the bolts.

Therefore, the above-described double-glazed window structure is disadvantageous due to a requirement for high-precision workmanship in the positioning of the add-on outer window frame and also due to a low efficiency in the construction thereof, because it is a usual practice that an exact base plane is first formed for attaching the bracket members by applying liner materials on to the exterior surface of the wall whereupon the add-on outer window frame is fastened to the bracket members with exact positioning.

SUMMARY OF THE INVENTION

The object of the present invention is therefore to provide a structure for a double-glazed window with an add-on outer window frame attached to the exterior surface of the building wall around the window opening which is free from the above-described problems in similar prior art structures.

The double-glazed window structure of the present invention comprises a ready-built inner window frame fixed to a window opening of a building, an add-on outer window frame fixed to the exterior surface of the wall of the building around the window opening, an intermediate frame connected to the inboard periphery of the add-on outer window frame to enter the window opening closely reaching the outboard periphery of the ready-built inner window frame, and a joint formed by filling the gap between the intermediate frame and the ready-built inner window frame with a sealing material.

DETAILED DESCRIPTION OF THE PREFERRED EMBODIMENTS

Figure 1:
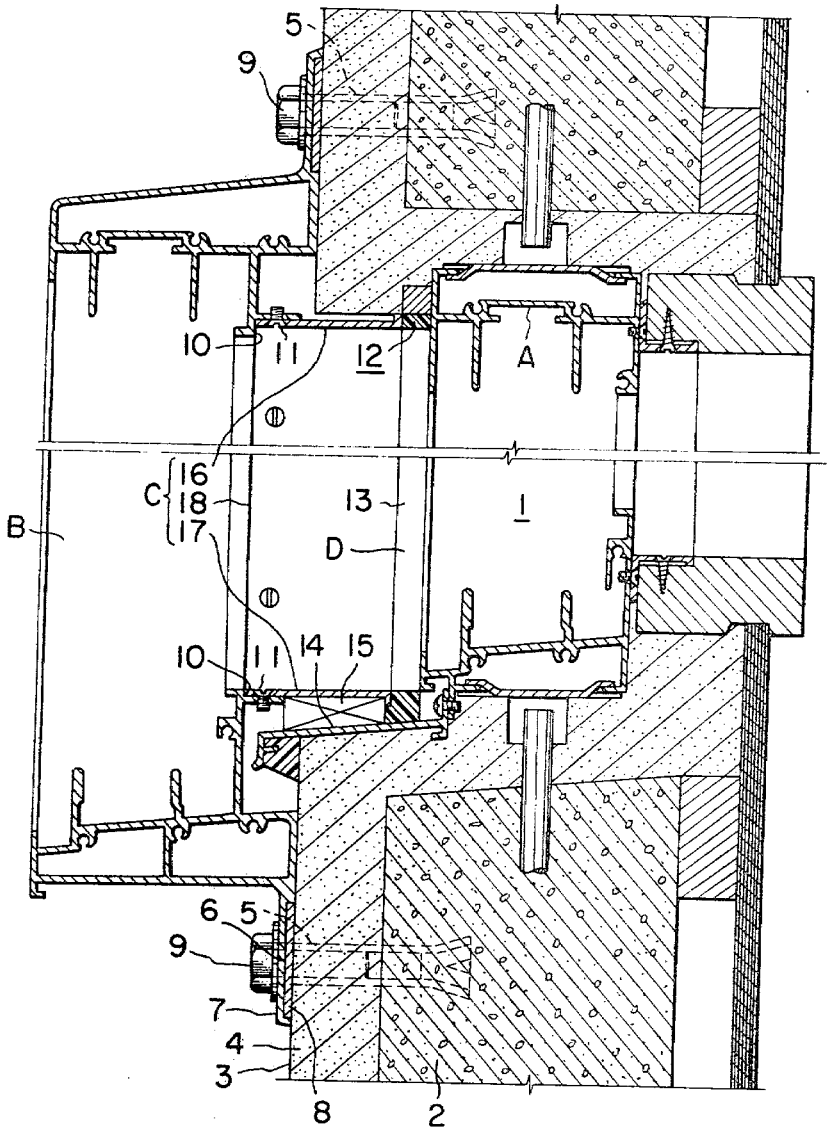
FIG. 1 is a vertical cross sectional view of a preferred embodiment of the invention.
Figure 2:
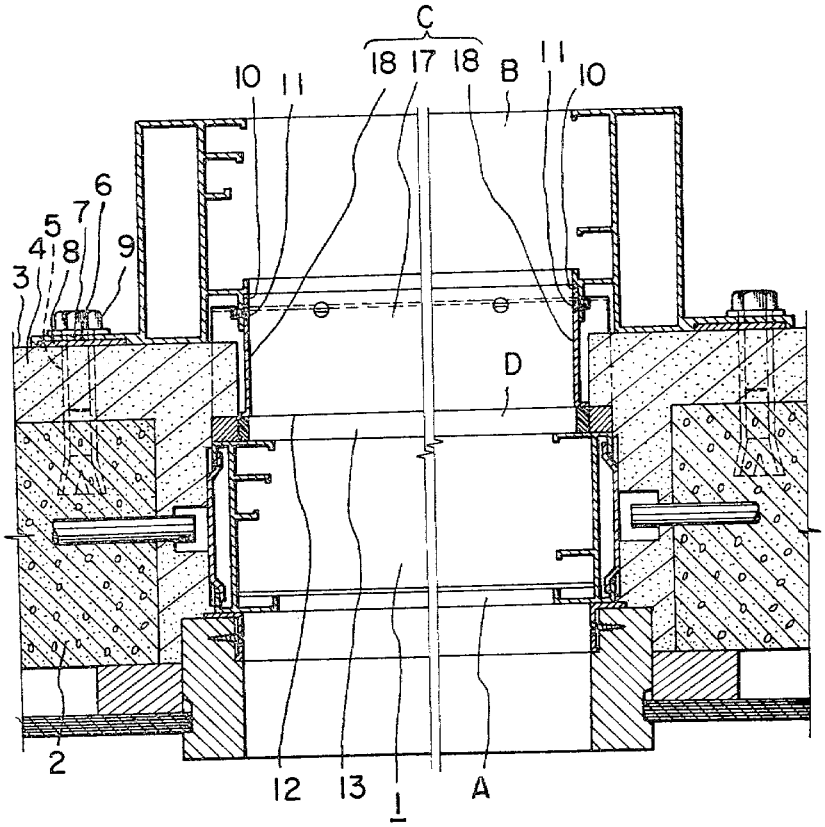
FIG. 2 is a horizontal cross sectional view of the same.

As is shown in FIG. 1 and FIG. 2, a ready-built inner window frame A with a water nosing 14 is secured to a window opening 1 of a building with anchorages embedded in the body 2 of the building and several anchorages with screw sockets or nuts 5 opening outwardly are embedded with suitable distances from each other in the exterior surface 3 of the body 2 around the window opening 1 through an outer finishing layer 4 made of cement mortar or the like material.

An add-on outer window frame B has several attaching pieces 7 extending outwardly from the inboard periphery thereof and facing the exterior surface 3 of a wall at positions corresponding to the above mentioned anchorages with sockets 5, each of the attaching pieces 7 being provided with an opening 6 through which a bolt 9 is screwed into the socket 5 to fasten the add-on outer window frame B to the exterior surface 3 of the building wall with intervention of a packing material 8.

The inboard periphery of the add-on outer window frame B is provided with a step-like part 10 which facilitates positioning of the window frame B to the window opening 1 and also improves fitting of the frame B therein. An intermediate frame C is fastened to the step-like part 10 of the add-on outer window frame B with several screws 11 entering the window opening 1 closely reaching the outboard periphery of the ready-built inner window frame A when the add-on outer window frame B is set in the window opening 1 to form a narrow gap 12 between an intermediate frame C and the ready-built inner window frame A.

A joint D is formed by caulking gap 12 with a suitable sealing material 13. Into the space formed between a lower cross-member or sill 17 of the intermediate frame C and water nosing 14 extending from the ready-built inner window frame A is inserted a spacer 15 which supports the intermediate frame C and, consequently, the add-on outer window frame B while it is set in the window opening 1. The depth of the intermediate frame C, i.e. the width measured from the inboard periphery to the outboard periphery thereof, is not necessarily determined in a definite length but it may be determined approximately in accordance with the outward stretch of the water nosing 14 from the ready-built inner window frame A.

Figure 3:
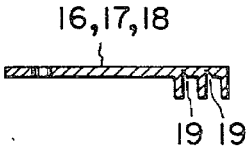
FIG. 3 is a cross sectional view showing the adjustable portion of an intermediate frame.

The intermediate frame C is formed with four members, i.e. an upper cross-member or head 16, the lower cross-member or sill 17 and a right upright and a left upright or jambs 18. It is preferred that several ditches 19 running in parallel longitudinally are engraved in the back surface of the inboard periphery of each of the above-mentioned four members at regular intervals as shown in FIG. 3, so that any excess peripheral portions of the intermediate frame C can be removed by breaking along one of the ditches 19 to give better fitting of the intermediate frame C with the outboard periphery of the ready-built inner window frame A with an adjusted depth of the intermediate frame C.

In the above-described embodiment of the invention, the add-on outer window frame B is directly attached to the exterior surface 3 of the wall but it is optional of course that the frame B is indirectly attached to the surface 3 utilizing bracket members as is the case in the prior art double-glazed window structures.

As has been described above, the double-glazed window structure embodying the present invention is characterized by providing an intermediate frame to the add-on outer window frame without being connected to the ready-built inner window frame to leave, instead, a gap therebetween which is filled with a suitable sealing material forming the joint. Therefore, the structure is very versatile even when the outward stretch of the window opening differs considerably or the accuracy in the finishing of the exterior surface of the wall is low because of compensation for the difference in the depth of the intermediate frame as well as any error in working, so that the work of construction can be finished rapidly and conveniently and dispense with such precision positioning of the add-on outer window frame as required in the prior art double-glazed window structures. In addition, the joint formed with a suitable sealing material serves as a connection between the intermediate frame and the ready-built inner window frame so as to integrate the ready-built inner window frame, the intermediate frame and the add-on outer window frame into a unit and to prevent accumulation or intrusion of dust owing to the absence of an unfilled gap therebetween.

What we claim is:

1. A double-glazed window structure which comprises a ready-built window frame fixed to a window opening of a building, an add-on window frame fixed to the exterior surface of the wall of the building around the window opening, an intermediate frame connected to the inboard periphery of the add-on window frame to enter the window opening closely reaching the outboard periphery of the ready-built window frame, and a joint formed by filling the gap between the intermediate frame and the ready-built window frame with a sealing material, wherein the intermediate frame is formed with an upper cross-member, a lower cross-member, a right upright and a left upright, each of the cross-members and the uprights being provided with a plurality of ditches running in parallel longitudinally with regular intervals engraved on the back surface of the inboard peripheral portion thereof, along which the intermediate frame can be readily broken to remove excessive length so as to adjust the depth of the intermediate frame.

2. A double-glazed window structure as claimed in claim 1 wherein the intermediate frame is supported by a spacer inserted into the space formed between the lower cross-member and the lower peripheral surface of the window opening.

3. A double-glazed structure as claimed in claim 1 wherein the add-on window frame is provided with a step-like part along the inboard periphery thereof and the intermediate frame is fastened to the step-like part.

* * * * *